US005380216A

United States Patent [19]

Broeksteeg et al.

[11] Patent Number: 5,380,216

[45] Date of Patent: Jan. 10, 1995

[54] CABLE BACKPANEL INTERCONNECTION

[75] Inventors: Johannes Broeksteeg, Hertogensingel; Lucas Soes, Rosmalen, both of Netherlands

[73] Assignee: The Whitaker Corporation, Wilmington, Del.

[21] Appl. No.: 52,054

[22] Filed: Apr. 21, 1993

[30] Foreign Application Priority Data

May 11, 1992 [GB] United Kingdom ..... 9210119
May 11, 1992 [GB] United Kingdom ..... 9210131

[51] Int. Cl.[6] ..... H01R 13/627

[52] U.S. Cl. ..... 439/352; 439/358; 439/680

[58] Field of Search ..... 439/345, 350, 357, 358, 439/180, 352, 108, 610, 579, 677, 680, 681

[56] References Cited

U.S. PATENT DOCUMENTS

| | | | |
|---|---|---|---|
| 4,032,209 | 6/1977 | Rutkowski | 439/355 |
| 4,448,471 | 5/1984 | Berry et al. . | |
| 4,579,412 | 4/1986 | Czeschka et al. . | |
| 4,681,387 | 7/1987 | Paddock | 439/347 |
| 4,893,263 | 1/1990 | Myers | 439/352 X |
| 4,986,768 | 1/1991 | Bramkamp et al. | 439/680 |
| 5,011,425 | 4/1991 | Van Zanten et al. | 439/358 X |
| 5,090,920 | 2/1992 | Casey | 439/355 X |
| 5,137,467 | 8/1992 | Arai | 439/374 |
| 5,199,902 | 4/1993 | Kahle et al. | 439/352 X |

FOREIGN PATENT DOCUMENTS

| | | | |
|---|---|---|---|
| 2801427 | 7/1978 | Germany | 439/372 |

OTHER PUBLICATIONS

Research Disclosure, 20122 Electrical Connector with Multifunction Cover, Jan. 1981.

*Primary Examiner*—Khiem Nguyen
*Attorney, Agent, or Firm*—Eric J. Groen; Adrian J. LaRue

[57] ABSTRACT

A backplane assembly includes a backplane board having a plurality of connector assemblies connected thereto for electrical connection with a header mounted on a backplane. The header includes a plurality of pins defining a pin field on the opposite side of the backplane. The pins extend through a mounting rail providing support for a plurality of cable connectors. The mounting rail is stamped and formed to include alignment slots whereas the cable connector is moulded to define alignment ribs. The cable connector housing includes latching arms on opposite sides thereof having locking lugs which lock in place within apertures in the mounting rail. A release mechanism is positioned between the latching arms such that outward movement of the mechanism moves the latching arms together disconnecting the cable connectors from the mounting rail. A twinaxial cable connector inner housing can also be positioned in the cable connector housing, where the inner housing is comprised of outer housings and an inner insert. Twinaxial cable having signal pairs, are aligned with pin receiving openings in the inner housing. Outer shield members are provided with integral terminals which surround the signal contacts to form a fully shielded differential pair of signals.

8 Claims, 16 Drawing Sheets

12
8
6
2
14
16
4
38
18
46
10

CABLE BACKPANEL INTERCONNECTION

BACKGROUND OF THE INVENTION

1. Field of the Invention

The subject invention relates to an electrical connector system which can be interconnected to a backpanel interconnectable with a daughter board electrical connector system, and to a high frequency electrical connector for use with the system.

2. Description of the Prior Art

A daughter board electrical connector is shown in European patent application 0 422 785, which is interconnectable to a pin header which mounts on a back panel. It is also advantageous to extend the pins of the above mentioned header entirely through the back panel, and to provide a cable connection to it. One of the difficulties encountered is that variable lengths of connections are required, and thus the system must be modular in nature. Moreover, this system is on a rather small grid, 2 mm×2 mm, and thus these cable connections must be easily accessible and useable by the end user.

It is advantageous in this system to have the provision for connecting coax or twinax cable connectors thereto, although this often results in a complicated design, or otherwise large connector system resulting in a large quantity of overall space required.

It is an object of the invention then to provide modular connector system for mounting to a back panel, where the system is useable in various lengths.

It is a further object of the invention to provide a mounting rail or header for placement over the pins extending from the backplane, where the mounting rail includes both keying and latching means.

It is a further object of the invention to provide an easily disconnectable cable connector including means to assist in the disconnection of such cable connectors.

A further object of the invention is to provide for a twinaxial cable connector system, where the signal contacts are fully shielded, thereby separating the pairs of twinaxial cables into differential pairs.

SUMMARY OF THE INVENTION

The objects have been accomplished by providing an electrical connection system for mounting to a printed circuit board, where the system comprises a stamped and formed mounting rail having a lower base portion for placement over a plurality of pins mounted on the printed circuit board, the mounting rail further comprising two parallel and opposed vertical sidewalls, at least one of said side walls having a keying mechanism, and at least one of said sidewalls having a latching member. The system further comprises a cable connector having a plurality of electrical terminals for mating with the pins on the printed circuit board, the connector housing including a complementary keying mechanism and latching element for polarization and locking in said mounting rail.

In another aspect of the invention, a high frequency electrical connector for twinaxial or coaxial cable has at least one signal conductor and a shielding braid surrounding the signal conductor. The connector comprises an insulative housing comprising at least two signal contact carrying passageways, separated by a ground carrying contact passageway. At least two signal carrying contacts are positioned in said respective passageways, having a contact portion for mating with a complementary connector and a connection portion for connecting with a signal conductor. Shielding is at least partially surrounding said housing, comprised of at least upper and lower shield cover parts, where either said upper or lower cover part includes a contact portion for engagement with the ground shield of cable, and where said upper and lower cover part includes shielding portions above and below said passageways, and one of said upper or lower shield cover parts includes an integral contact part positioned in said ground carrying contact passageway.

BRIEF DESCRIPTION OF THE DRAWINGS

FIG. 3 is an isometric view of the mounting rail shown in FIG. 1;

FIG. 13 shows the inner housing portion of FIG. 12 with outer shielding members positioned around the housing;

DETAILED DESCRIPTION OF THE PREFERRED EMBODIMENT

Figure 1:
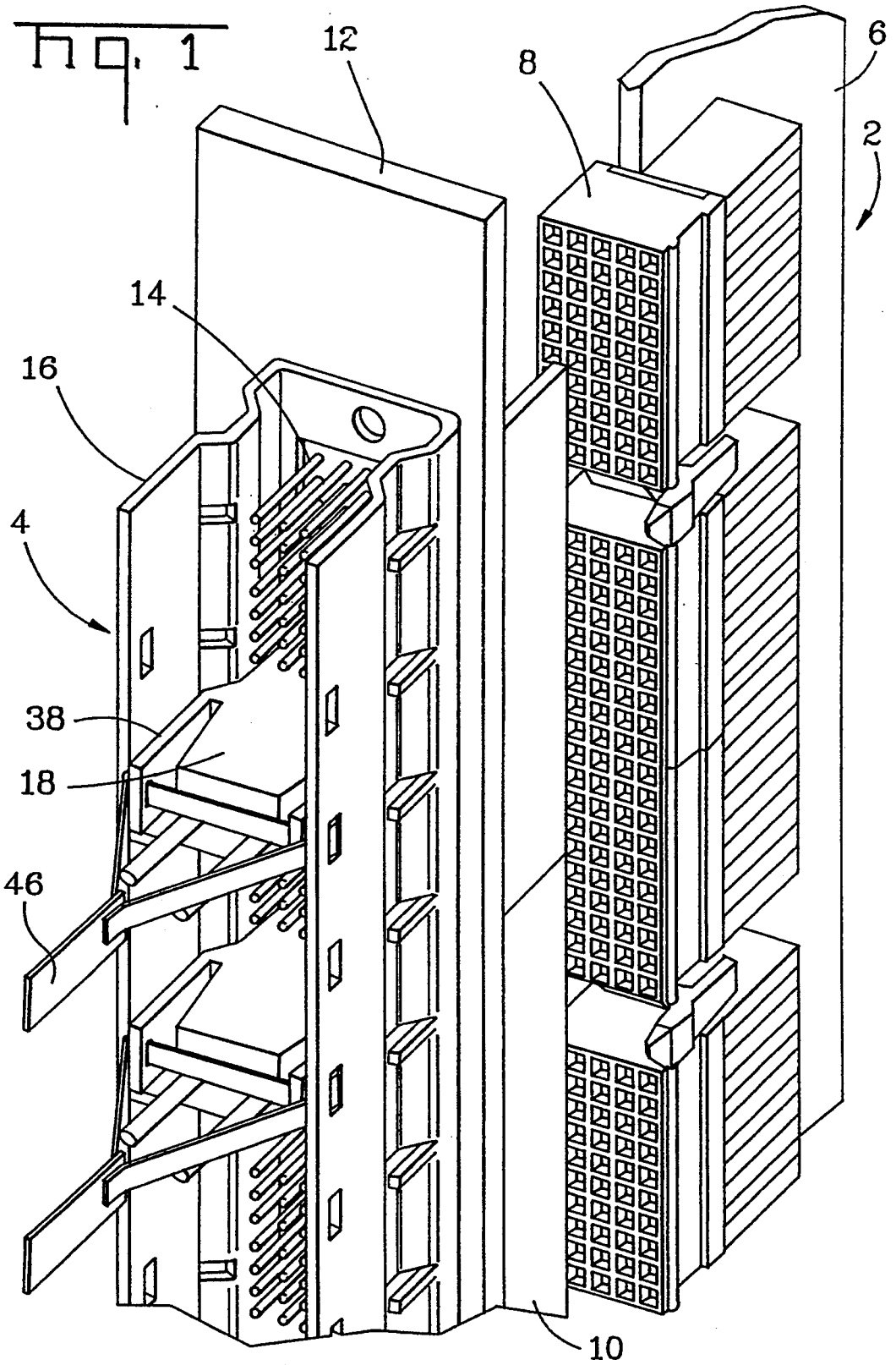
FIG. 1 is an isometric view of a daughter board electrical connector poised for receipt with a pin field on a backpanel, and the backpanel cable interconnection system positioned on the backpanel.

With reference first to FIG. 1, a backplane assembly is shown comprised of a daughter board connector 2 which is substantially similar to that shown in European Publication number 0 422 785. The daughter board assembly 2 is comprised of a daughter board 6 having a plurality of connector housings 8 mounted thereto which are electrically connectable to header connectors 10 providing a pin field on both sides of a backplane 12. Pins extend through the back plane 12, such that a pin field is formed within the headers 10 for electrical connection with the daughter board connectors 8, and further comprise a pin field on the opposite side of the backplane 12 providing a pin field for the cable connector assembly 4.

Figure 2:
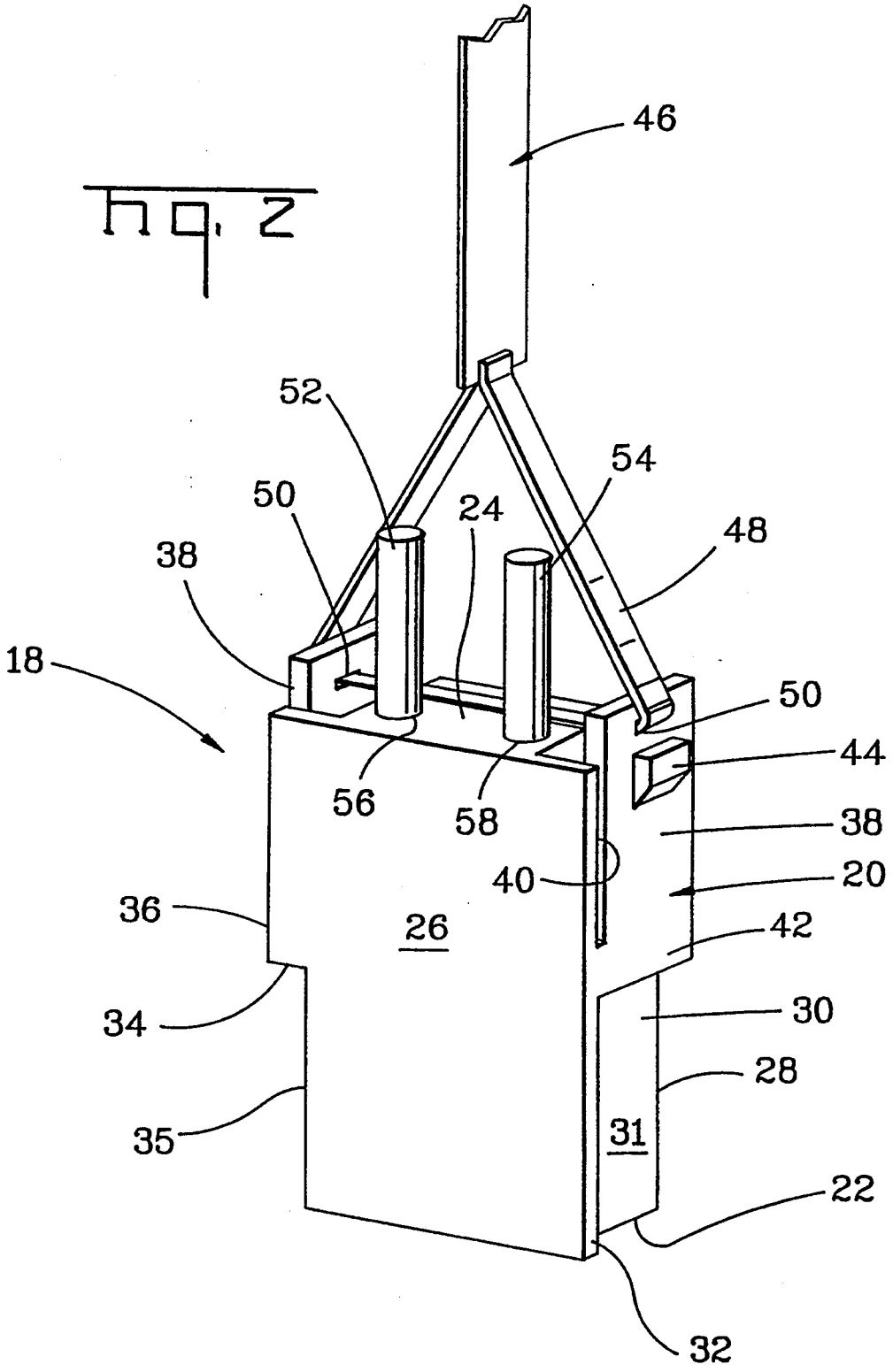
FIG. 2 is an enlarged view of the cable connector shown in FIG. 1.

The cable assembly 4 is comprised of a stamped and formed mounting rail 16 positioned over the pin field formed by the pins 14, together with a plurality of connector assemblies 18. With reference now to FIG. 2, the individual connector assembly 18 will be described in greater detail. The connector 18 is comprised of an insulating housing shown generally at 20 having a lower mating face 22 and a rear cable receiving face 24. The housing 20 further comprises a side wall 26 and an opposite side wall 28. The housing 20 includes a notched section at 30 thereby defining a recessed surface 31 and a rib 32 generally extending along one side edge of the side wall 26. The opposite side includes a notched section 34 for clearance purposes as will be described herein, thereby defining a lower alignment edge 36. The housing 20 further includes two latch arms 38 integrally formed with the connector housing 20 and being moveable towards and away from each other, the two latch arms 38 being formed with a side seam shown at 40, and being hinged at a lower section 42. Each latch arm 38 includes a latching lug portion 44 for locking the connector 18 in position within the mounting rail 16. The latch arms 38 are moveable to an unlocked position by way of a release mechanism shown generally at 46 comprised of a plastic strip 48 which extends through apertures 50 adjacent to the free ends of the latch arms 38, such that upward movement of the mechanism 46 pulls the arms towards each other thereby moving the locking lugs 44 inwardly for releasement.

In a preferred embodiment of the invention, the connector 18 is profiled as a 20 position connector, having four rows of five contacts across, and therefore the front mating face 22 has corresponding pin receiving openings for receiving the pins 14 of the backplane connector 12. Two ten-conductor cables 52 and 54 extend through corresponding openings 56 and 58 through the rear cable receiving face 24 for electrical connection with electrical contacts in the connector 18. It should be appreciated that the cable receiving openings 56 and 58 are offset from the center line of the connector such that it does not interfere with the operation of the plastic strip 48 which extends between the latching arms 38.

Figure 4:
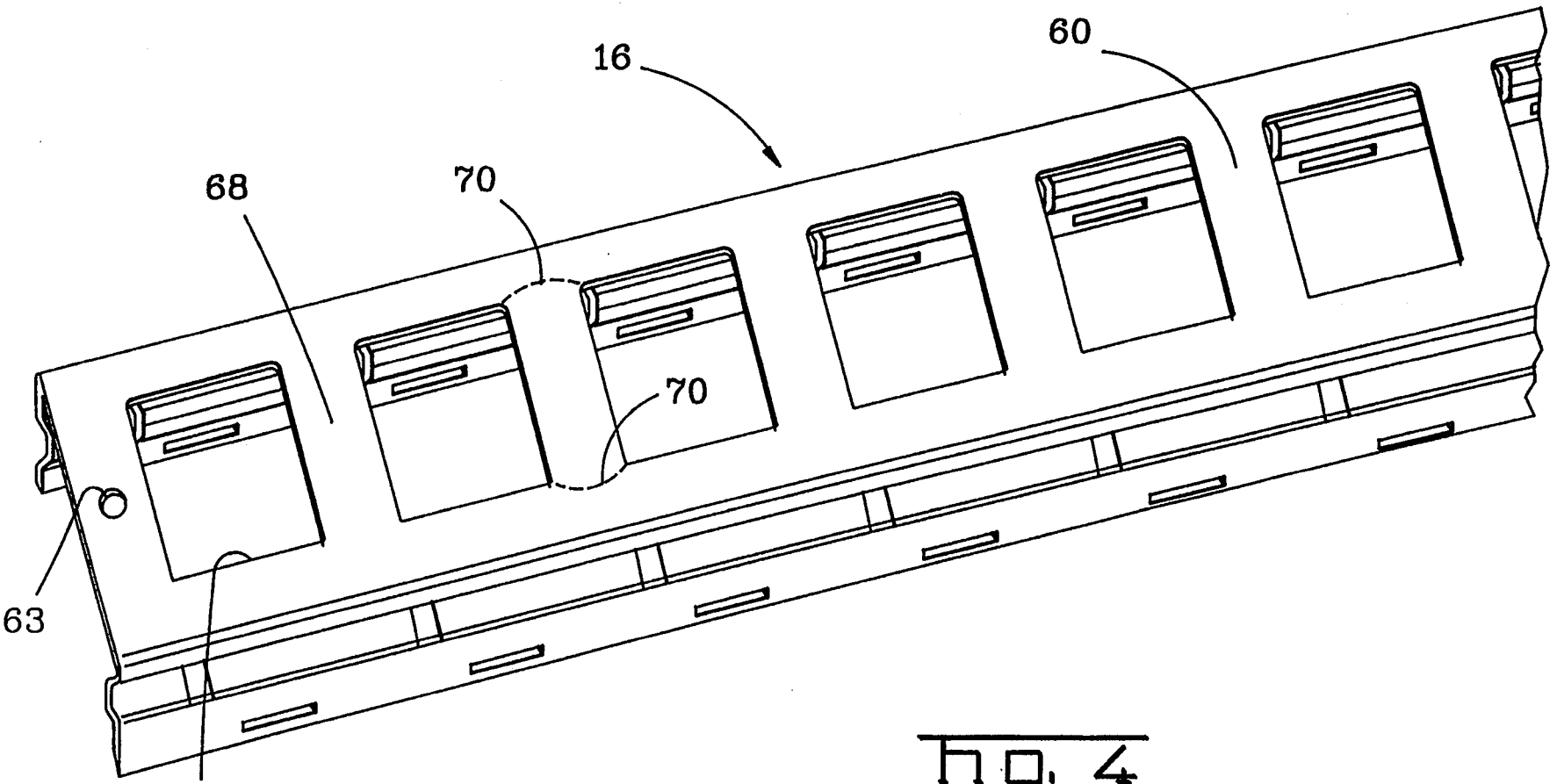
FIG. 4 is an isometric view from the lower surface of the mounting rail shown in FIG. 3.

With respect now to FIGS. 3 and 4, the mounting rail 16 is shown in greater detail. The mounting rail 16 is in the preferred embodiment stamped and formed from a flat strip of metal material to comprise a lower mounting plate 60 and two upright vertical walls 62 and 64. The lower mounting plate 60 comprises mounting apertures 63 for mounting the rail 16 to the backplane 12 as shown in FIG. 1. The lower mounting surface 60 further includes a plurality of openings at 66 (FIG. 4) which provide access for the pins 14 (FIG. 1) to extend upwardly therethrough. It should be appreciated from FIG. 4 that the openings 66 are symmetrically positioned along the lower mounting face 60 separated by strap portions 68, although adjacent openings 66 could be joined by removing one or more of the strap portions, for example by severing the lower plate portion 60 at 70. Each side wall 62 and 64 contains a plurality of apertures 72 (FIG. 3) which are profiled to receive the latching lugs 44 (FIG. 2) of the cable connector 18.

As shown in FIG. 3, the side wall 62 includes a stamped recess at 74 extending along the longitudinal length of the side wall 62 thereby defining an inner surface at 76. A plurality of slots 78 are stamped out of the side wall 62 positioned above the surface 76, whereas a plurality of ribs 80 are stamped from the side walls 62, but are not stamped free from the side wall, but rather extend in a co-planer manner with the surface 76. With reference still to FIG. 3, the side wall 64 includes a stamped recess 84 providing an inner surface at 86. A plurality of ribs 88 are stamped free of the side wall 64 and extend upwardly in a co-planar arrangement with the side wall 64, thereby defining a plurality of continuous slots at 90.

Figure 7:
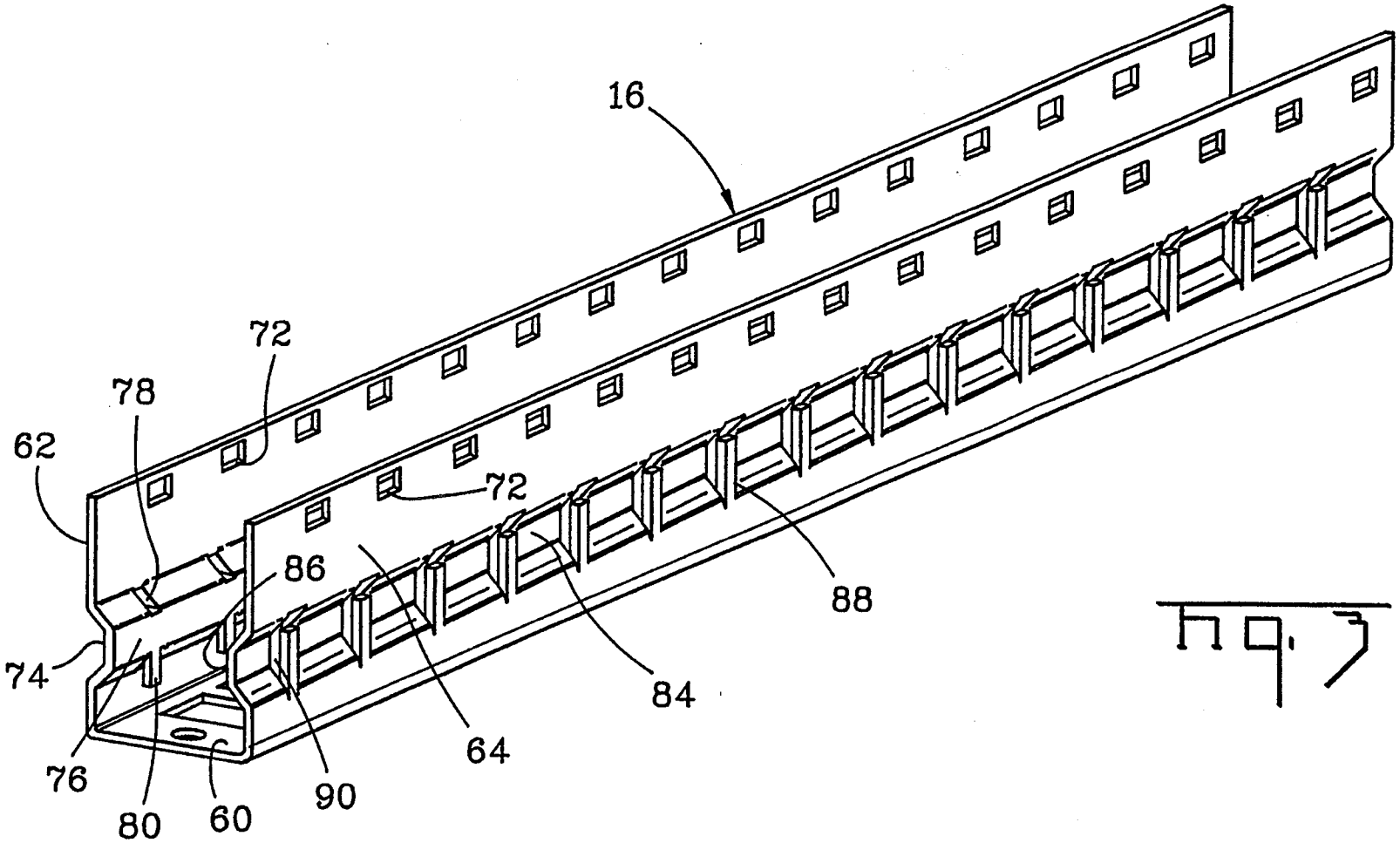
FIG. 7 is a view showing how the mounting rail as shown in FIG. 5 can be stored on a reel for subsequent forming into the mounting rail.
Figure 5:
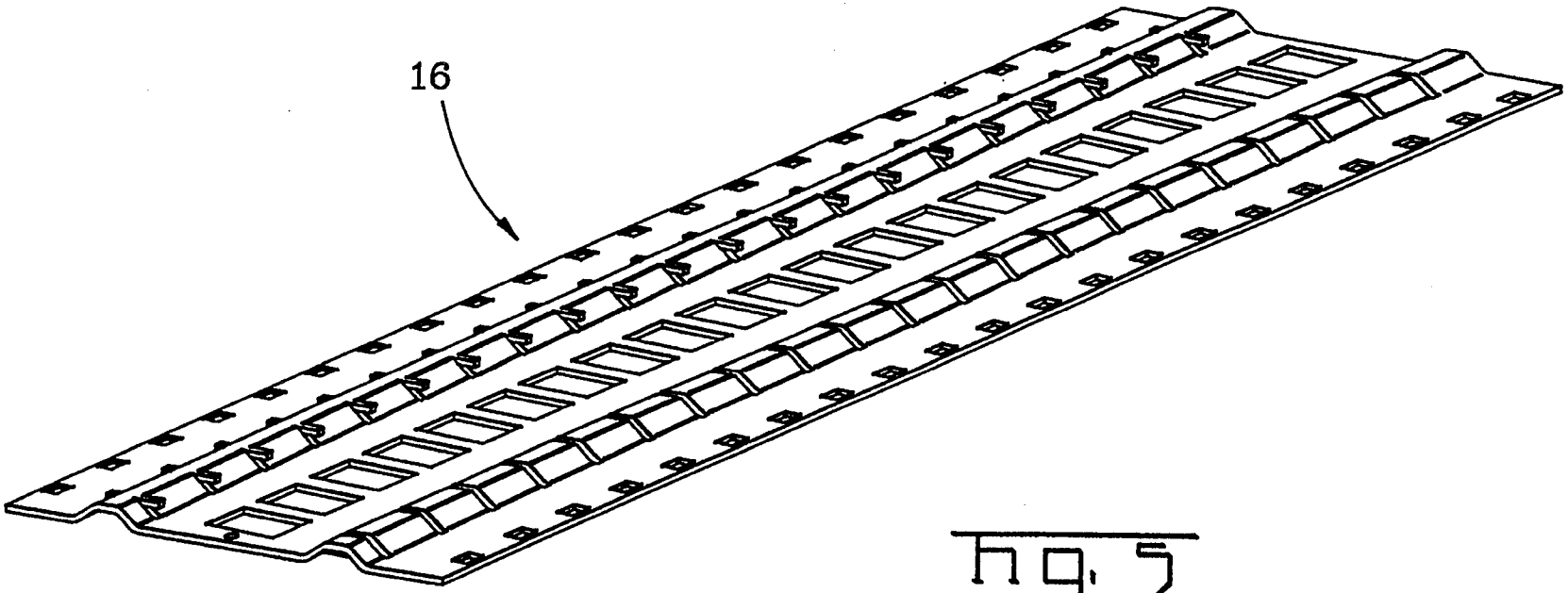
FIG. 5 is an isometric view of the rail prior to forming the vertical upstanding side walls of the mounting rail.
Figure 6:
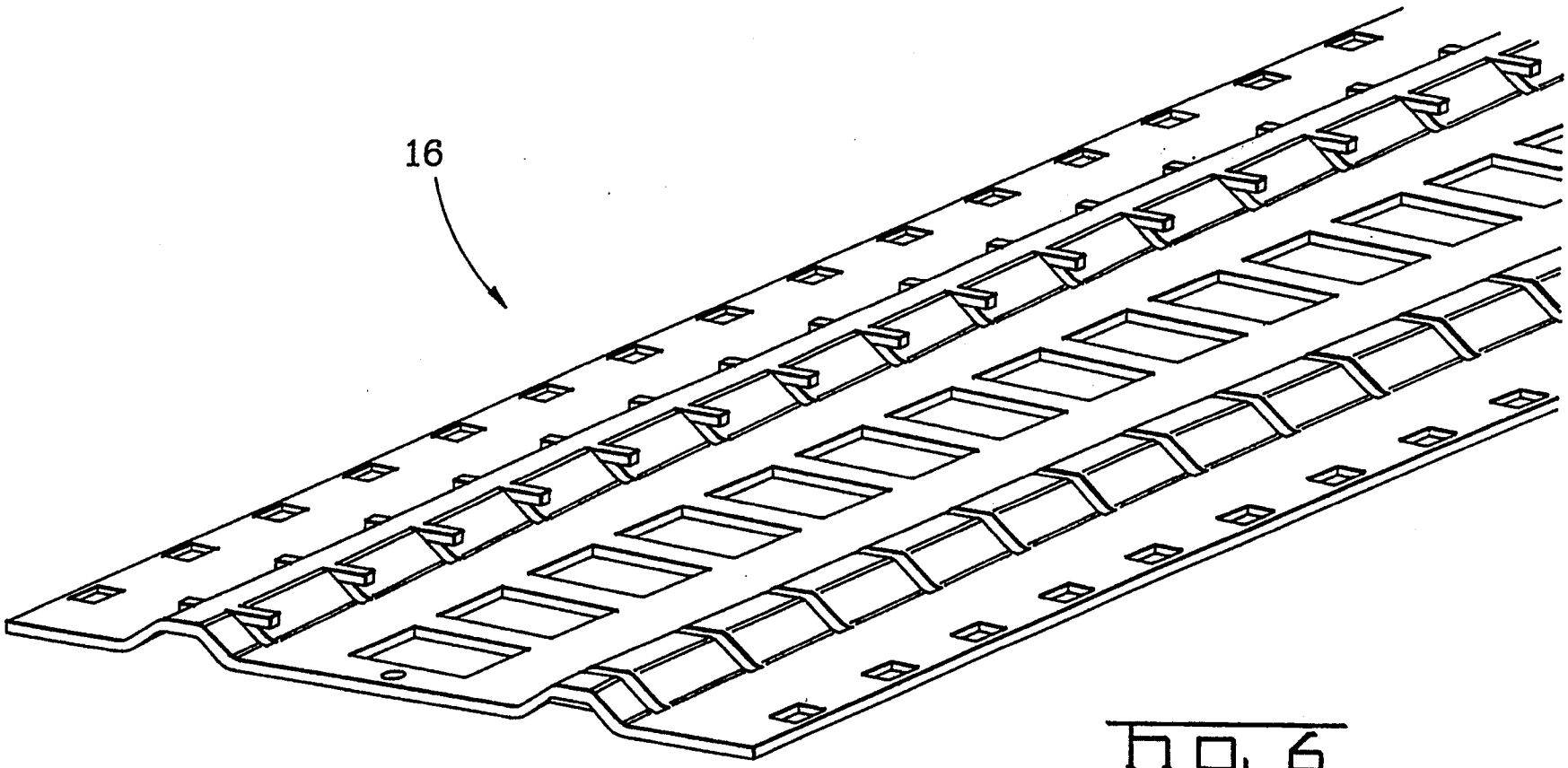
FIG. 6 is an enlarged section of the mounting rail as shown in FIG. 5.
Figure 7:
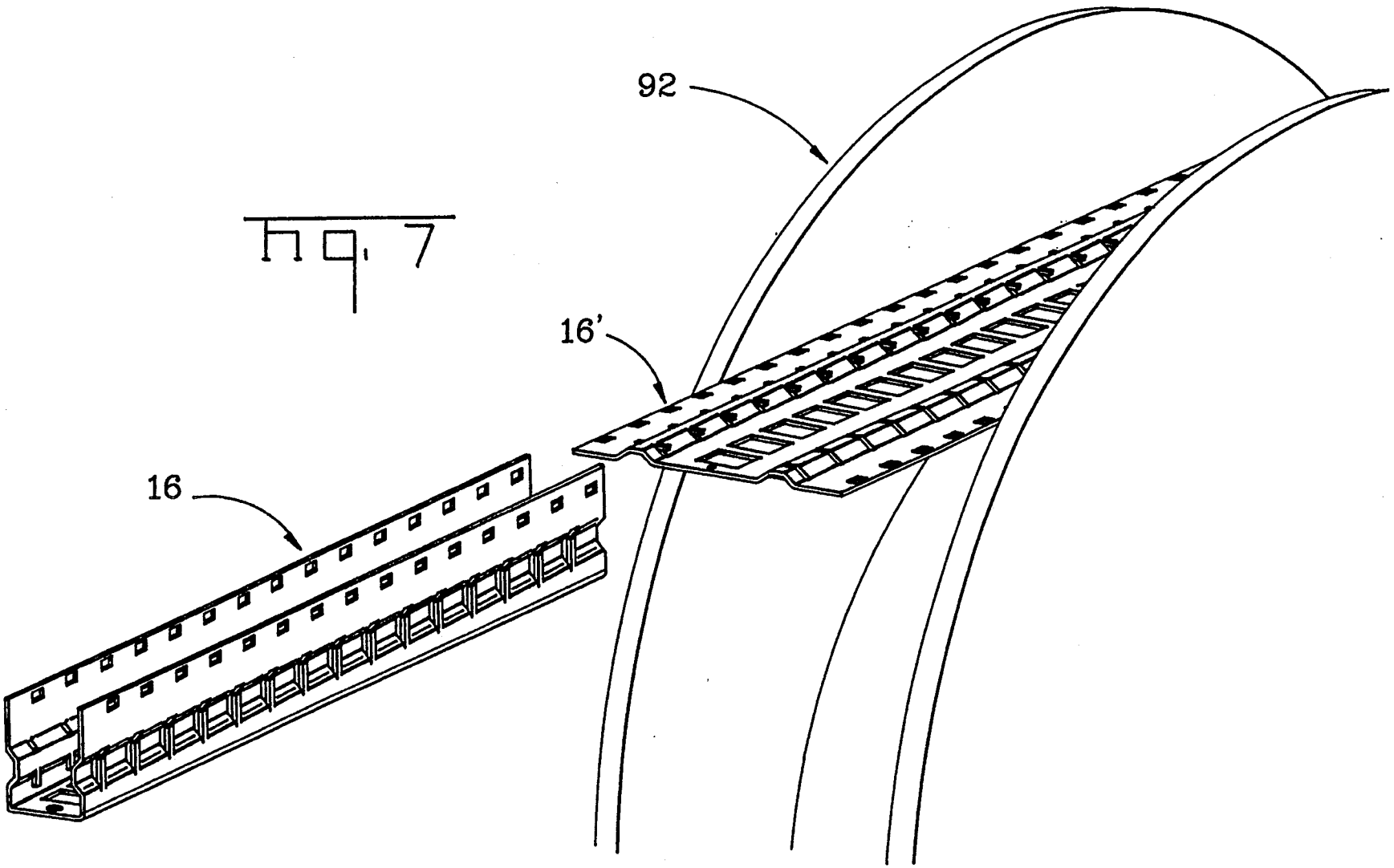

In the preferred embodiment of the invention, the mounting rail 16 is stamped and formed in a flat strip and as shown in FIGS. 5–7, and can be taken up and stored on a reel 92, whereby the strip material shown at 16′ can be dereeled sheared and formed into the appropriate length as shown in FIG. 7.

Figure 8:
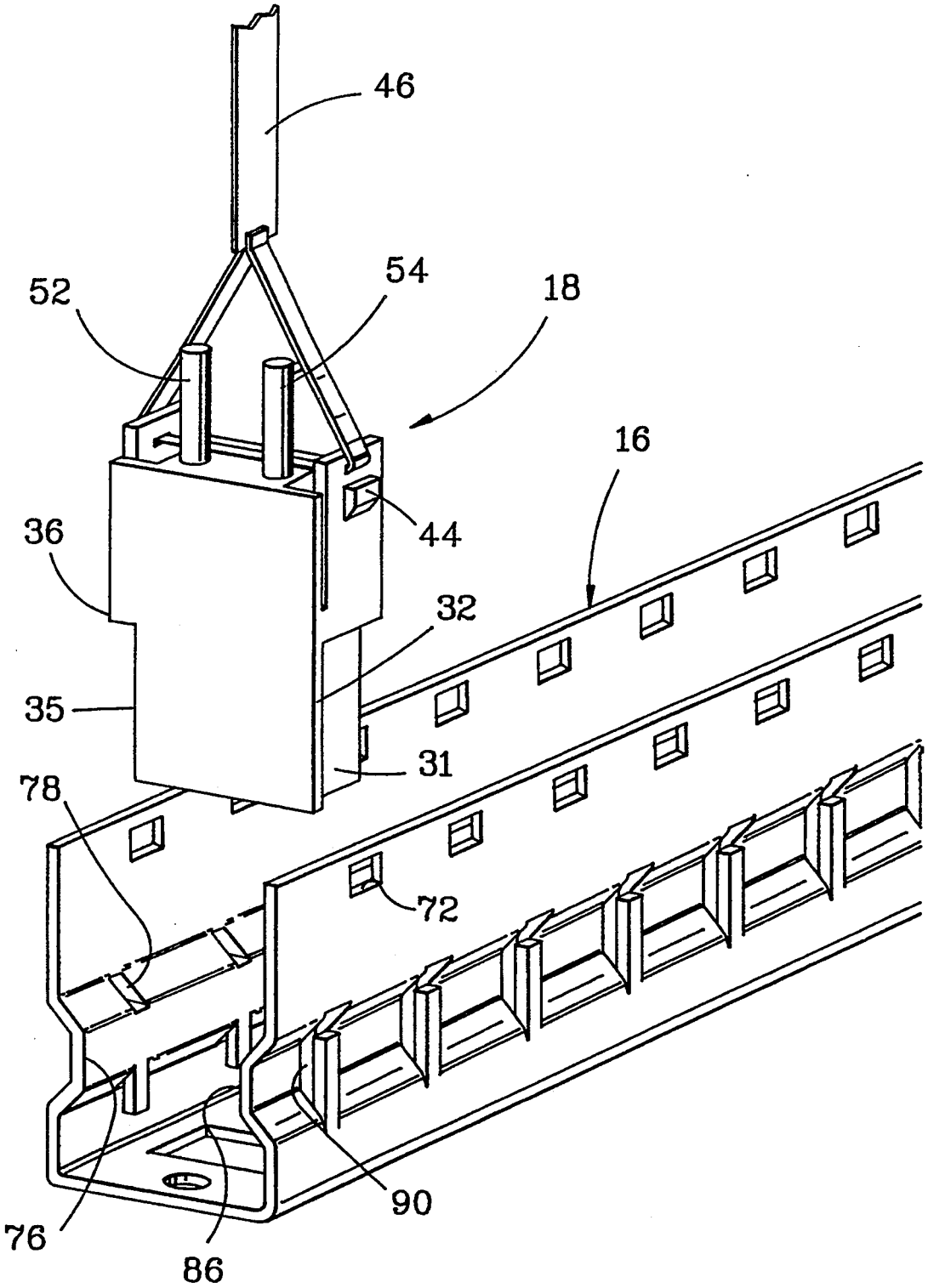
FIG. 8 shows the alignment of one of the connector housings as shown in FIG. 2 with the mounting rail.
Figure 9:
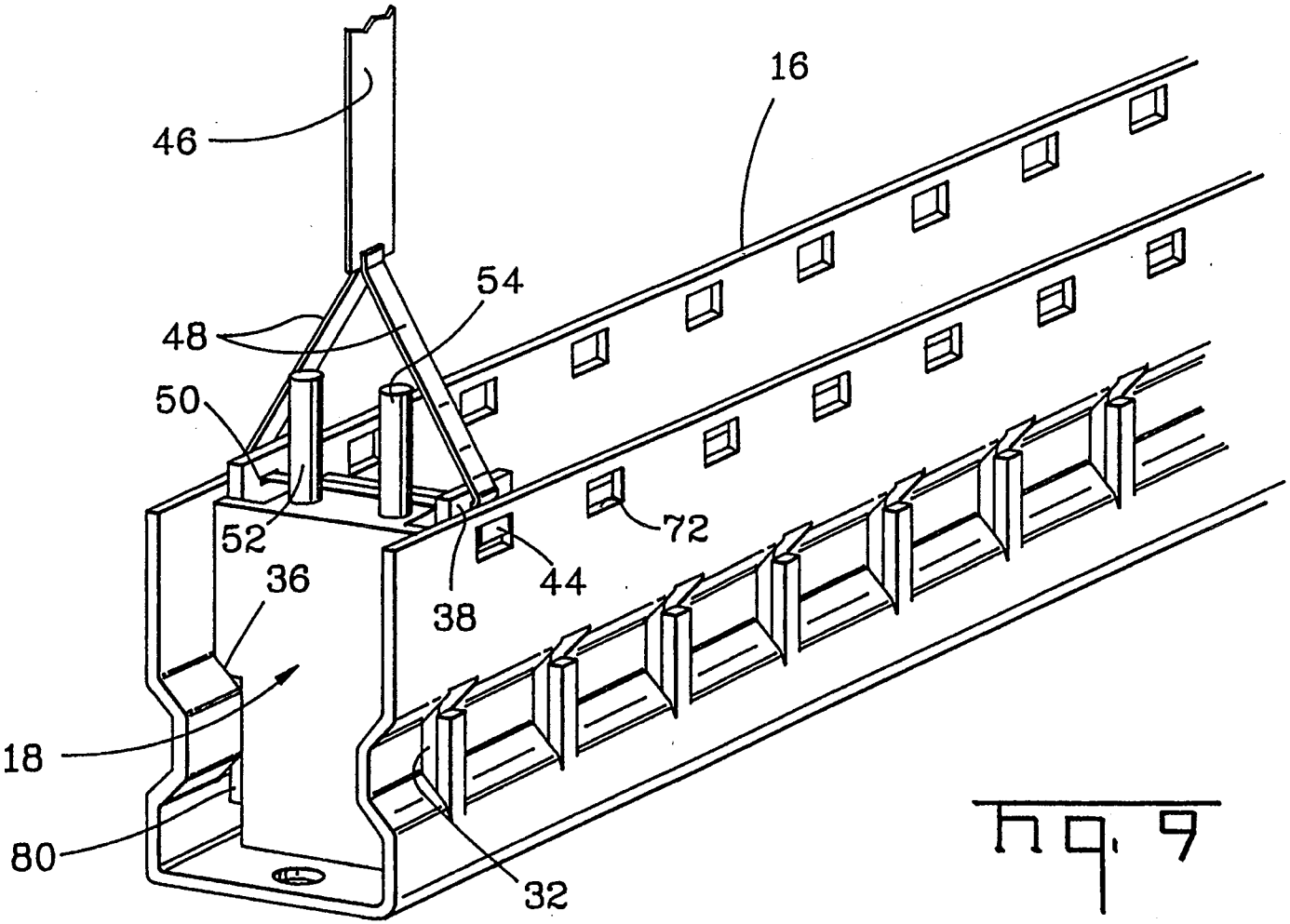
FIG. 9 shows the cable connector in a fully connected position with the mounting rail.
Figure 10:
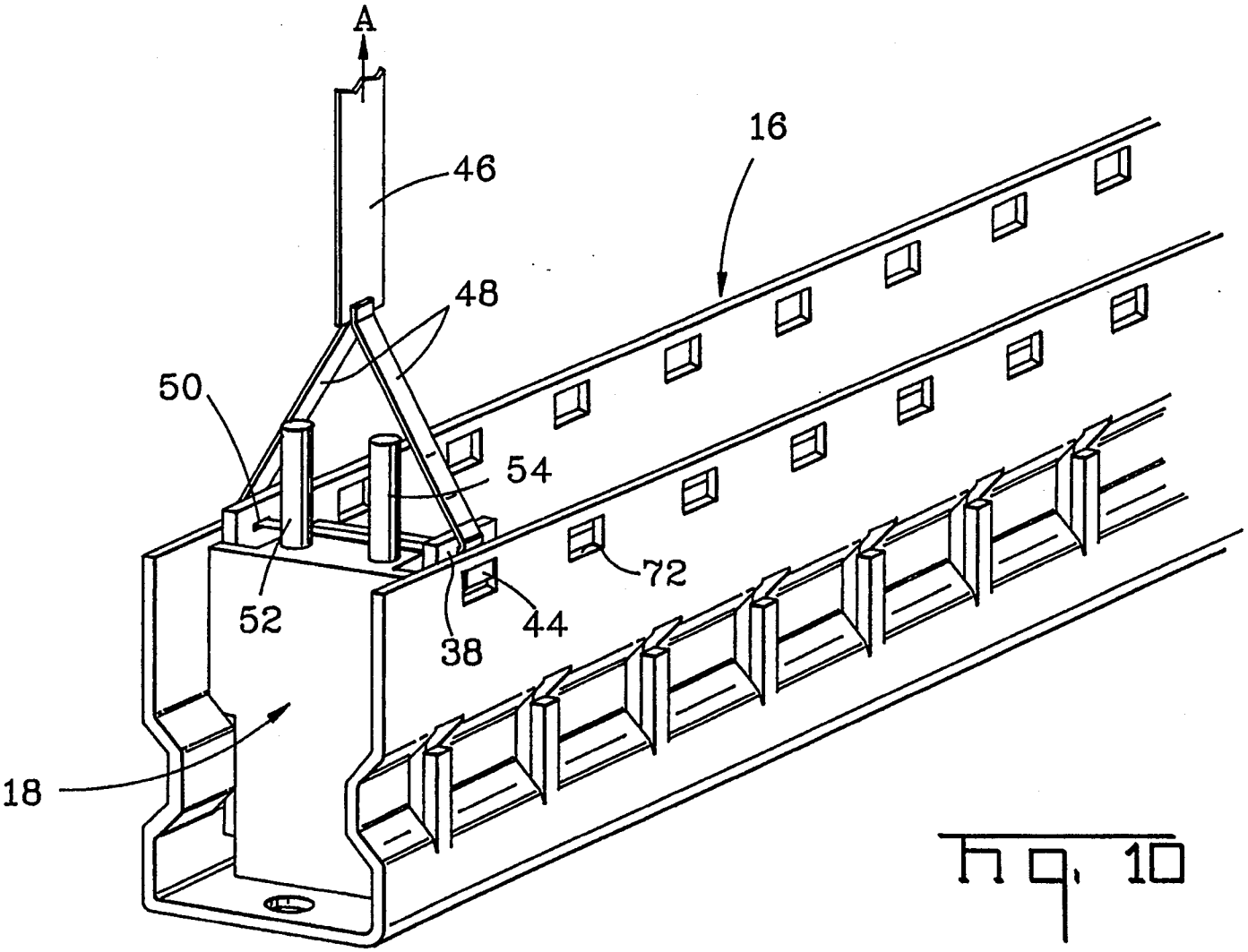
FIG. 10 shows the disconnection of the connector shown in FIGS. 8 and 9.
Figure 11:
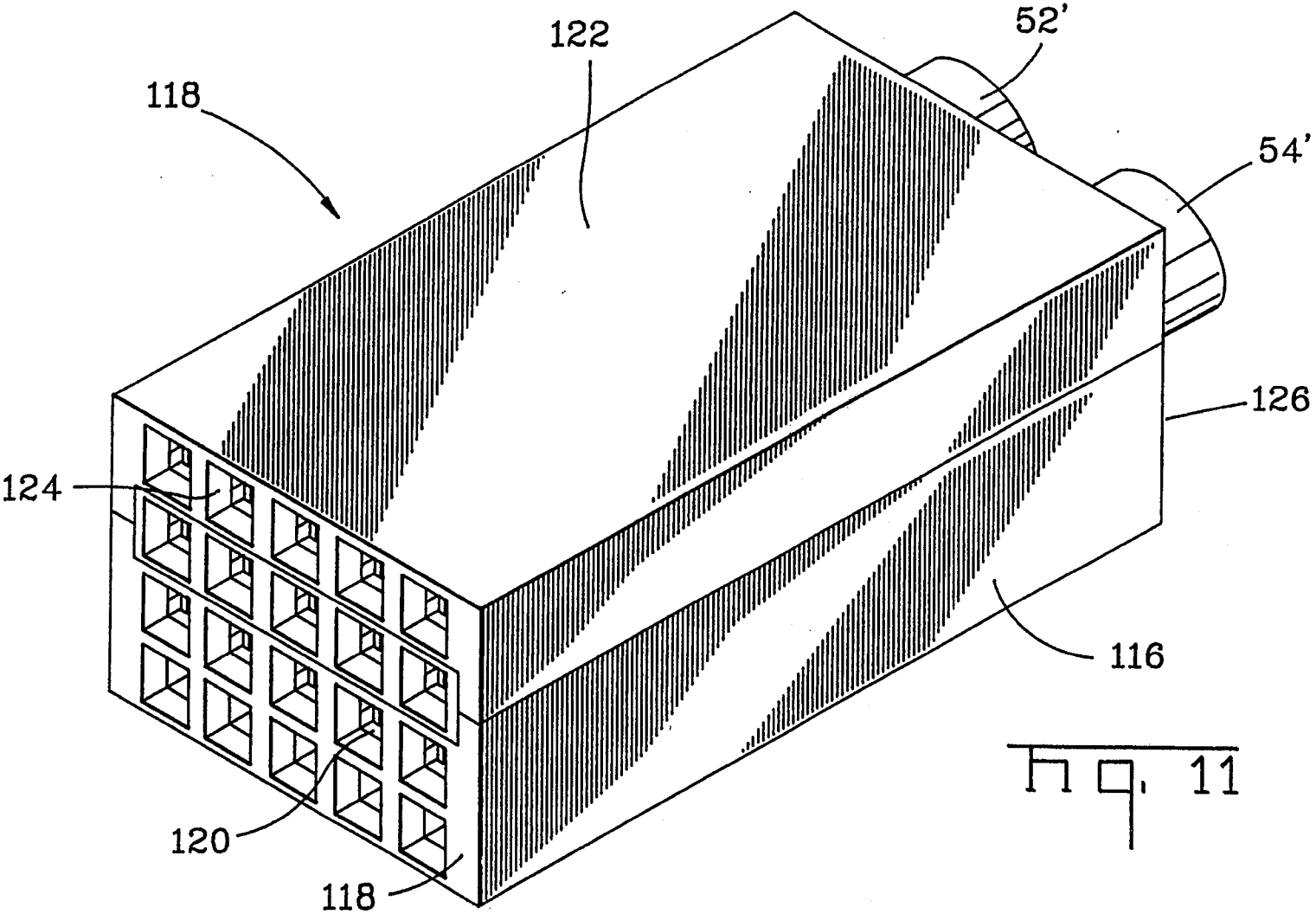
FIG. 11 shows an assembled view of the detail of the cable connector shown in FIG. 1.

With the mounting rail 16 and connector housing 18 as described above, the mounting rail 16 can be mounted to a backplane 12 as shown in FIG. 1 with the pin field 14 of the header connector 10 extending therethrough and a plurality of cable connectors 18 can be interconnected to the daughter board assembly 2 via the pins 14. With reference to FIG. 8, the cable connector 18 can be positioned above the mounting rail 16 with the rib 32 aligned with one of the ribs 90 and with the rib 36 aligned with the slot 78. It should be appreciated that the inner surfaces 76 and 86 are profiled to receive the side surfaces 31 and 35 of the connector 18 while the connector 18 is aligned with the mounting rail 16 and the pins 14 by way of the ribs 32 and 36. As shown in FIG. 9, the connector 18 is shown fully inserted in the mounting rail 16 with the ribs 36 and 32 positioned in corresponding slots 78 and 90 (FIG. 8). In this position, the locking lugs 44 are latched into position with the apertures 72 on the side walls of the mounting rail 16. It should be appreciated that the connector 18 is easily disconnected from the mounting rail 16 and from the backplane assembly via pulling the release mechanism 46 in the direction of arrow A FIG. 10 which moves the latching arms 38 inwardly thereby releasing the latching lugs 44 from the corresponding apertures 72. It should be appreciated that the release mechanisms 46 provide great ease in disconnecting the cable connector 18 from the back panel.

It should also be appreciated that by stamping the mounting rail 16 into a longitudinal length of flat strip 16′, that the mounting rail can be produced easily and inexpensively yet provide all the features necessary for mounting and aligning the various connectors 18. It should be appreciated that any number of longitudinal lengths will be required housing any number of connector assemblies 18. If the mounting rail 16 were moulded from a plastic material, several different mould cavities will be required to mould the various lengths, while extruding the mounting rail for plastic material could not provide the alignment features necessary for the connector.

With reference now to FIGS. 11–15, a high frequency connector for alternative use with the outer housing 20 (FIG. 2) will be described. With respect to FIG. 11, the cable connector includes an inner housing assembly comprised of a lower housing portion 116 having a front mating face 118 having a plurality of pin receiving openings at 120. The connector 118 further comprises an upper cover part 122 having a plurality of pin receiving openings at 124. The complementary covers 116 and 122 cooperatively provide cable receiving openings through a rear face, such as at 126.

Figure 12:
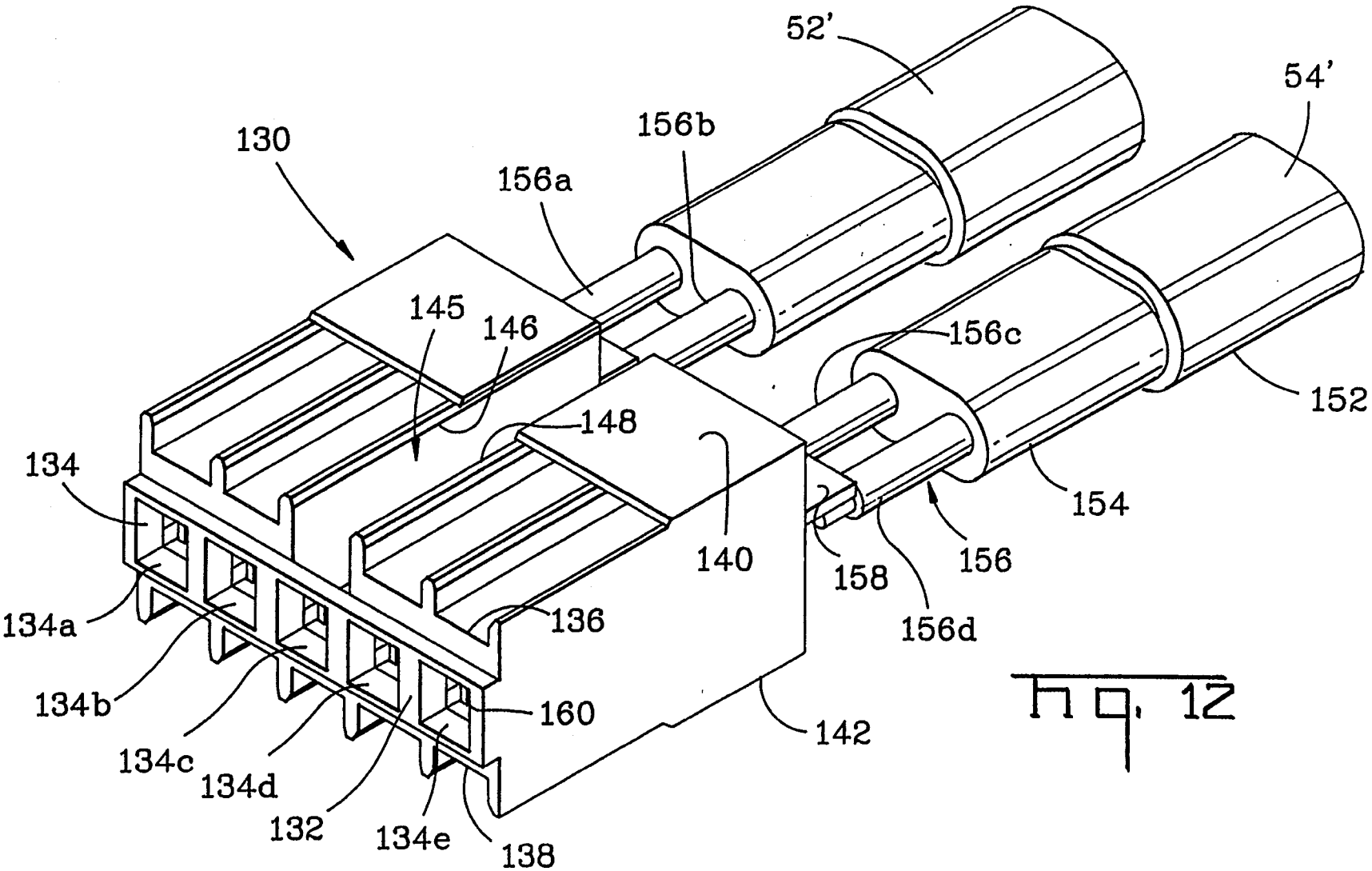
FIG. 12 shows an inner housing part of the cable connector of FIG. 11.
Figure 17:
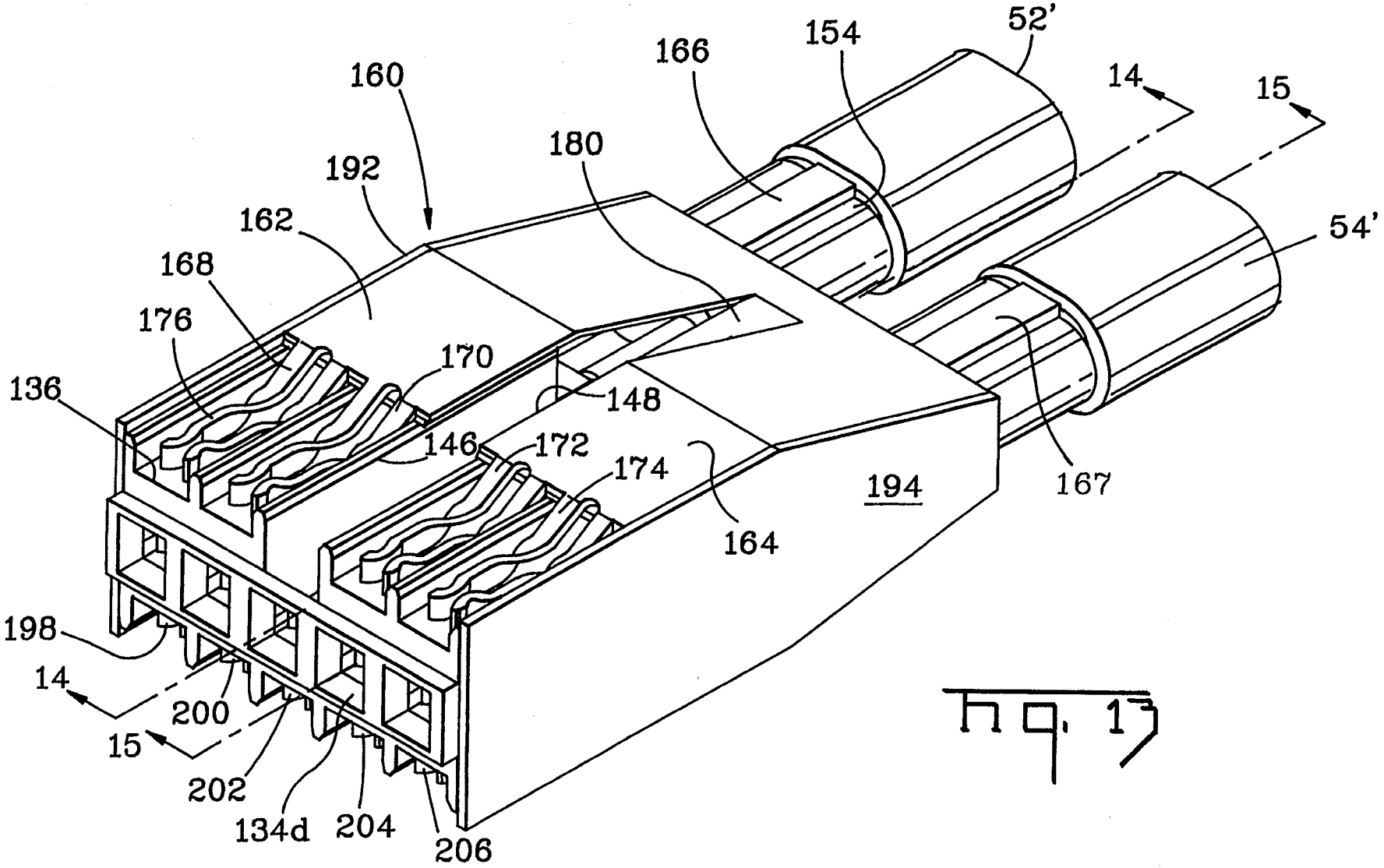

With respect now to FIG. 12, an inner insert housing portion is shown at 130 comprising a front face 132 having pin receiving openings shown generally at 134, and terminal receiving channels such as 136 and 138 positioned on upper and lower surfaces 140, 142 thereof. With reference still to FIG. 12, it should be appreciated that a central channel 145 is defined between side walls 146 and 148 which provides a communication with the center pin receiving opening at 134*c*. As shown in FIG. 12, the inner housing portion 130 is interconnected to two twinaxial cables 52' and 54' comprised of an outer insulative portion 152 having a shielded section at 154 and two twinaxial cable pairs: 156*a*, 156*b*, 156*c*, 156*d*. It should be appreciated from FIG. 12 that the two twinaxial signal conductors 156*a* and 156*b* are in alignment with the pin receiving openings 134*a* and 134*b* respectively, whereas twinaxial signal conductors 156*c* and 156*d* are in alignment with pin receiving openings 134*d* and 134*e* respectively. This leaves the center pin receiving opening 134*c* and the channel 145 empty.

Figure 14:
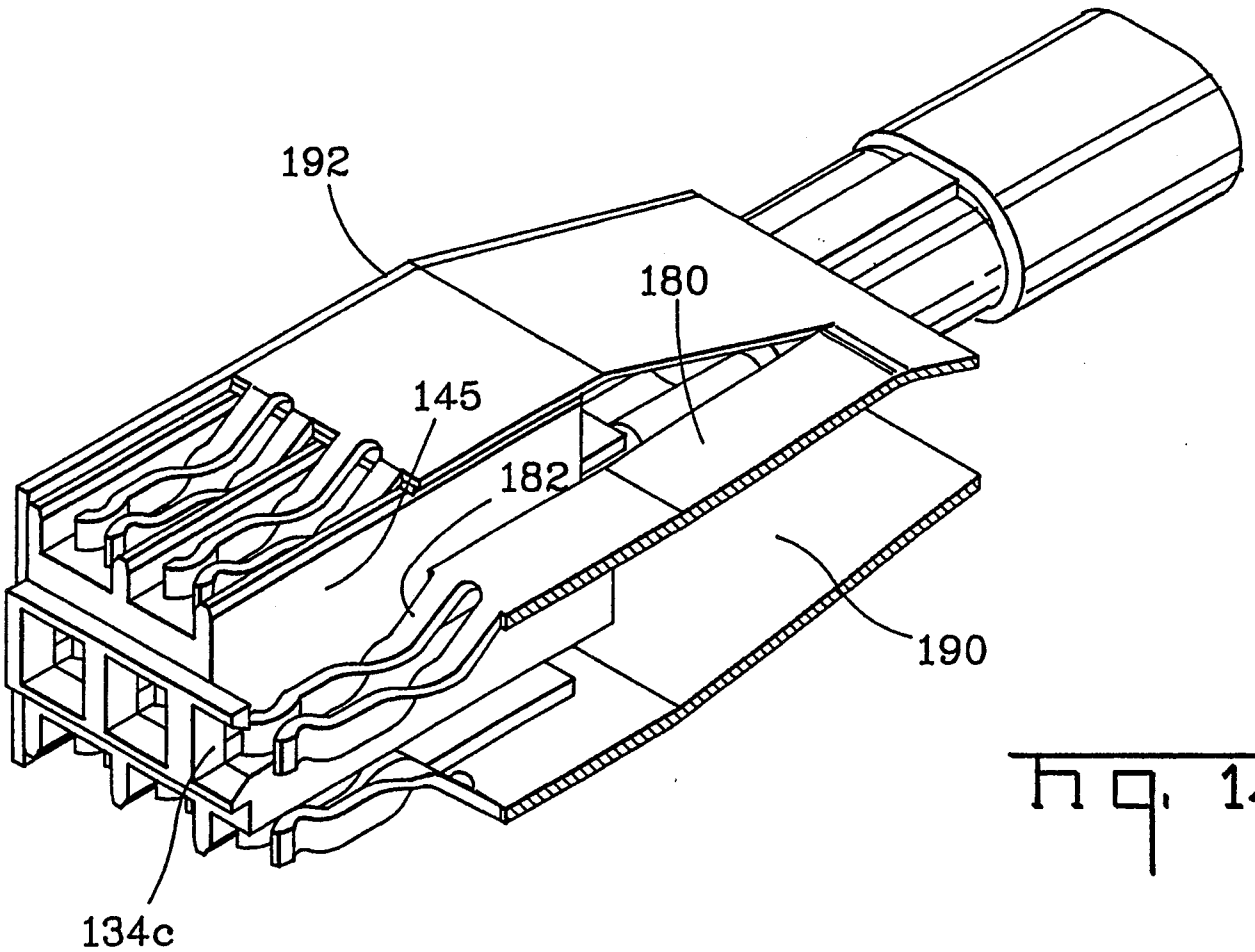
FIG. 14 is a cross-sectional view through lines 14—14 of FIG. 13.

With respect now to FIG. 13, a shield member is shown generally at 160 comprised of upper plate portions 162 and 164 with rear connecting sections 166 and 167 in contact with the shield 154 of the twinax cables 52', 54'. It should be appreciated that this connection could be by soldering, welding, or by way of ferrule or similar clamp. Two contact members 168 and 170 extend forwardly from the plate portion 162 whereas two contact members 172 and 174 extend forwardly from the plate portion 164. The contacts 168 and 170 are defined by bifurcated contact arms, shown generally at 176 in FIG. 13, which are positioned in two of the channels 136 whereas contacts 172 and 174 are positioned in the channels 136 above the pin receiving passageways 134*d* and 134*e*. A center ground tab 180 is stamped from a central plate section, intermediate plate sections 162 and 164, and includes an integral contact portion 182 as best shown in FIG. 14. This contact tab portion is bent downwardly into the channel 145 and intermediate the walls 146 and 148, (FIG. 13). As shown in FIG. 14, the contact portion 182 is aligned with the pin receiving opening at 134*c*. As shown in FIGS. 13 and 14, the shielding further comprises a lower shield member 190, and side plate portions 192 and 194. The lower shield portion 190 has integral contact members 198–206 (FIG. 13), identical to the integral contacts 168–174, the contact members being positioned in respective channels 138 (FIG. 12).

Figure 15:
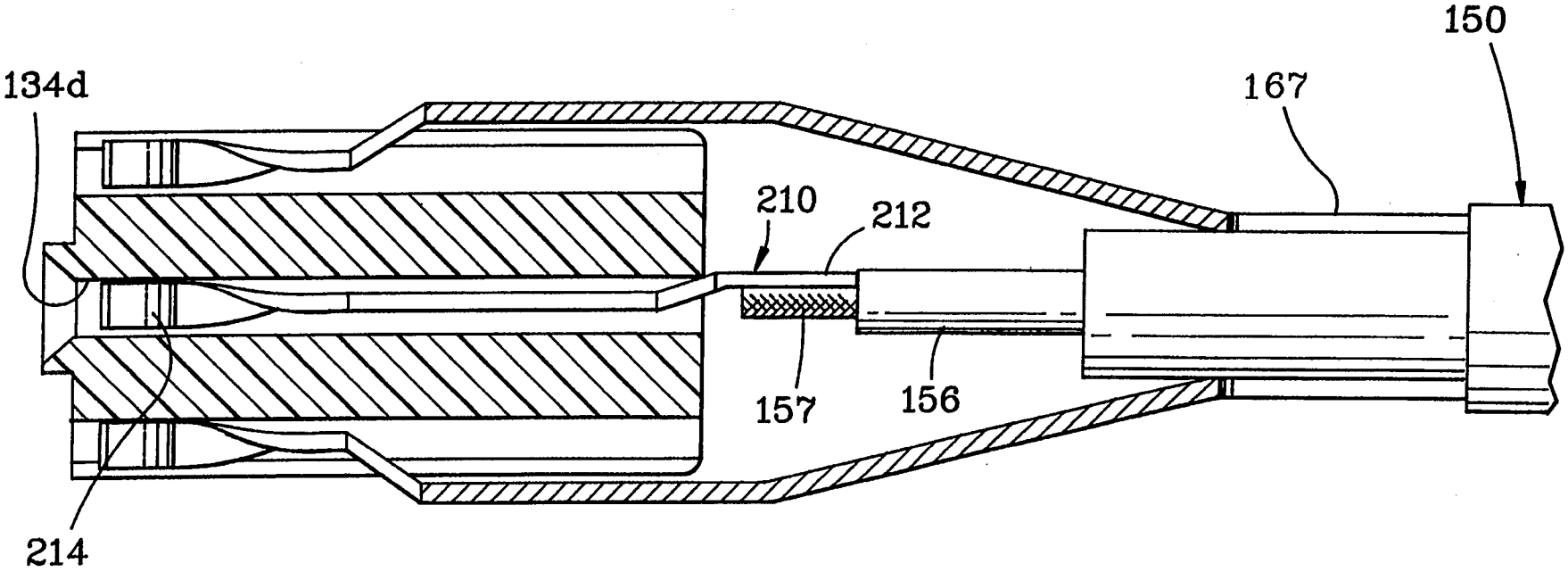
FIG. 15 is a cross-sectional view through lines 15—15 of FIG. 13.
Figure 16:
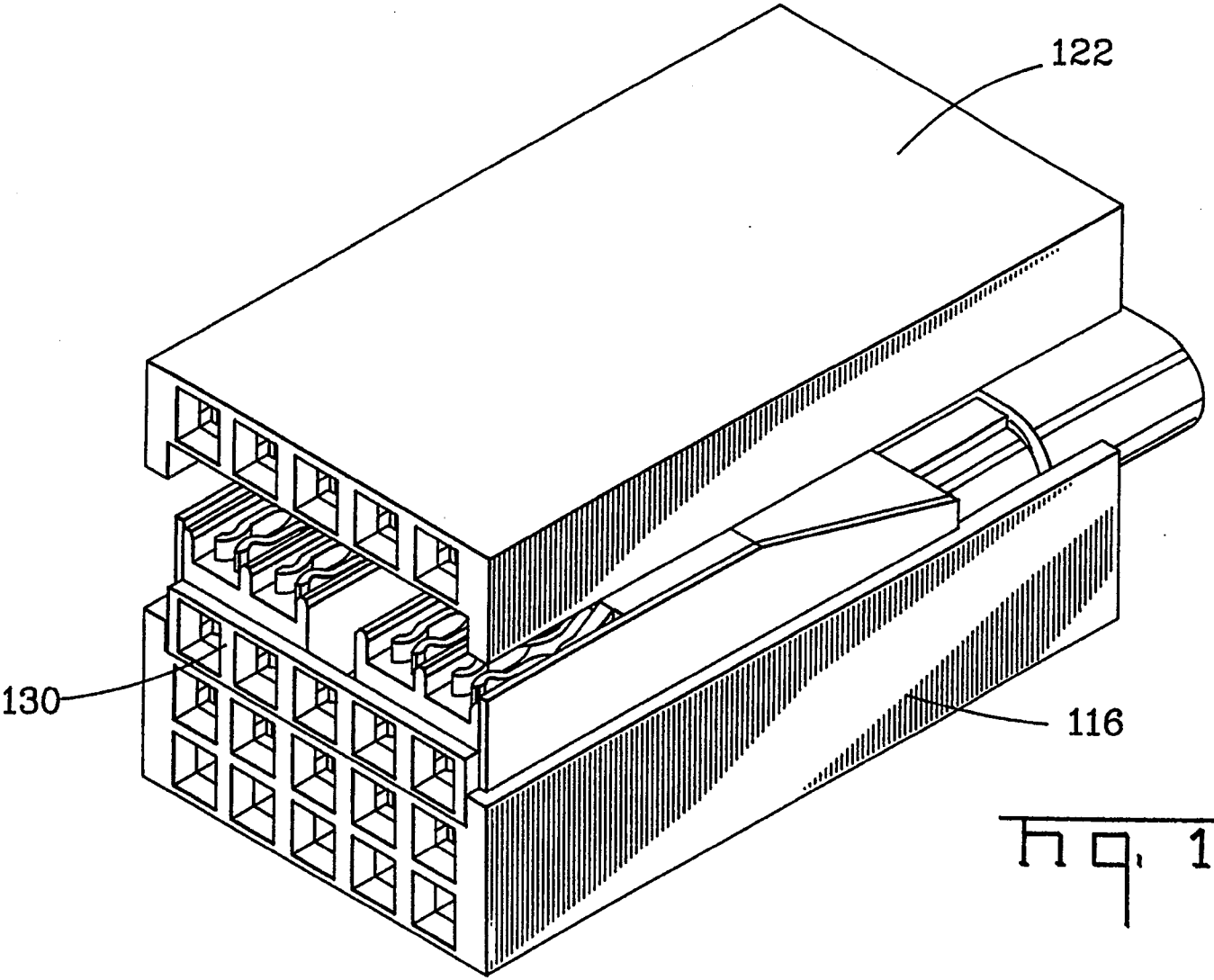
FIG. 16 is a view similar to that of FIG. 11 showing the top cover portion partially disassembled.

With respect now to FIG. 15, signal contacts 210 are shown connected to the signal conductor 157, where the signal conductor is positioned in passageway 134*d*. The contact 210 contains a connecting portion 212 for contact with the signal conductor 157, and a receptacle portion 214 for contact with a mating pin 14 on the pin field shown in FIG. 1. It should be understood that each passageway 134*a*–134*d* carries a terminal similar to contact 210, each separately connected to a respective conductor 156*a*–156*a*. After the electrical connections are made as shown in FIGS. 13–14, the upper and lower cover parts 116 and 122 can be positioned over the inner insert housing portion 130 to encapsulate the shielded members, as shown in FIG. 16.

Advantageously then, two separate differential pairs are fully shielded by way of the outer shield members together with the shielding contacts surrounding the signal contacts.

It should also be noted that the connector concept could also be used with three coaxial cables, where the signal conductors are aligned with passageways 134*a*, 134*c*, 134*e*; and where the upper shield has a contact similar to 180, 182 extending into cavities 134*b*, 134*d*, through channels (similar to 145) positioned above the cavities 134*b*, 134*d*.

We claim:

1. An electrical connection system for mounting to a printed circuit board, the system comprising:

a mounting rail having a lower base portion with at least one aperture for placement over a plurality of pins mounted on the printed circuit board, the mounting rail further comprising two parallel and opposed vertical sidewalls, at least one of said side walls having a keying mechanism, and at least one of said sidewalls having a latching member; and a cable connector having a plurality of electrical terminals for mating with the pins on the printed circuit board, and a connector housing in which said electrical terminals are secured and including a complementary keying mechanism and latching element for polarization and locking in said mounting rail.

2. The connector of claim 1, wherein said connector includes two latch arms for positioning between said sidewalls, said latch arms including a locking lug for interlocking with said latching member.

3. The connector of claim 2, wherein the latch arms are cooperably interconnected by way of a release member between them, such that a rearward pulling force on said release member, releases said lugs from said sidewall latching member.

4. The connector of claim 2 wherein at least one of said sidewalls contains an inwardly directed projection along the longitudinal length thereof, said projection including a vertical slot therethrough providing a keying slot; said connector housing including a keying rib extending beyond a sidewall, whereby the rib is receivable in said slot, and said inner surface of said projection supports said connector housing.

5. An electrical connector assembly comprising a tab header and receptacle for matable interconnection with the tab header, the tab header comprising a base wall through which extend a plurality of tabs, and sidewalls which flank said tabs, at least one of the sidewalls including a first latching member thereon, and wherein said receptacle is comprised of a housing for positioning between said sidewalls for latching therein, the assembly being characterized in that, the connector housing includes latch arms for positioning against said sidewalls, said latch arms including a second latching member cooperable with said first latching member, the latch arms being cooperably interconnected by a release member in the form of a strap member connected to both latch arms, whereby, actuation of said release member disconnects said latching members thereby disconnecting said connector housing from said tab header.

6. The connector of claim 5, wherein free ends of said strap member are joined to each other.

7. The connector of claim 6, wherein the strap member is one piece which extends through apertures in said latch arms, and then joined at the ends.

8. The connector of claim 7, wherein said strap member is made of plastic.

* * * * *